US005370280A

United States Patent [19]

Su

[11] Patent Number: 5,370,280

[45] Date of Patent: Dec. 6, 1994

[54] VALVE FOR A SPRAYER

[76] Inventor: Cheng-Yuan Su, No. 124, Tung Ta Road, Hsinchu City,

[21] Appl. No.: 165,818

[22] Filed: Dec. 14, 1993

[51] Int. Cl.[5] ..... B67D 5/42

[52] U.S. Cl. ..... 222/321; 222/385

[58] Field of Search ..... 222/321, 383, 385; 234/333

[56] References Cited

U.S. PATENT DOCUMENTS

| | | | |
|---|---|---|---|
| 3,908,870 | 9/1975 | Nozawa et al. | 222/385 |
| 4,025,046 | 5/1977 | Boris | 222/321 |
| 4,271,875 | 6/1981 | Meshberg | 222/385 |
| 4,277,001 | 7/1981 | Nozawa | 222/321 |
| 4,305,530 | 12/1981 | Nozawa | 222/321 |
| 4,369,900 | 1/1983 | Saito et al. | 222/321 |
| 4,462,549 | 7/1984 | Saito et al. | 222/321 |
| 4,606,479 | 8/1986 | Van Brocklin | 222/321 |
| 4,821,928 | 4/1989 | Su | 222/321 |
| 4,930,999 | 6/1990 | Brunet et al. | 222/321 |
| 4,964,547 | 10/1990 | Lina | 222/385 |

FOREIGN PATENT DOCUMENTS

| | | | |
|---|---|---|---|
| 342651 | 11/1989 | European Pat. Off. | 222/385 |
| 2314772 | 1/1977 | France . | |
| 2512517 | 3/1983 | France . | |
| 2004585 | 4/1979 | United Kingdom . | |

*Primary Examiner*—Andres Kashnikow
*Assistant Examiner*—Philippe Derakshani
*Attorney, Agent, or Firm*—Bacon & Thomas

[57] ABSTRACT

A valve for a sprayer, especially for a sprayer to be connected with a small liquid container, provides the sprayer with improved spraying effects with respect to both atomization of the sprayed liquid and sensitivity for the response by including a first rod having a smaller diameter, a second rod located below the first rod and having a larger diameter in comparison with that of the first rod, a third rod located below the second rod and having a largest diameter, and a fourth rod located below the third rod and having a reduced diameter in comparison with that of the third rod; wherein a top end of the first rod is formed with a conic shape; an annular shoulder is formed between the first rod and the second rod, on which a plurality of teeth-like grooves are provided; another annular shoulder is formed between the second rod and the third rod, which is inwardly recessed to form an inwardly recessed annular groove; and an outer peripheral surface of the third rod is provided with a plurality of axial liquid introduction grooves.

1 Claim, 5 Drawing Sheets

VALVE FOR A SPRAYER

FIELD OF THE INVENTION

This invention relates to a valve for a sprayer, and more particularly to one which has teeth-like grooves and an inwardly recessed groove at shoulders thereof, as well as axial liquid introduction grooves at the outermost surface thereof, to provide improved back pressure and upward introduction effects for liquid contained in a container connected with the sprayer.

BACKGROUND OF THE INVENTION

A forced sprayer (such as that for a perfume bottle) is known to be one which, in response to an external force, introduces a small amount of liquid from a container with which the sprayer is connected and sprays the liquid in an atomized form. Among various kinds of such sprayers the one which is mounted on an opening of a bottle and actuated to spray by being pressed is the most well-known. FIGS. 1–3 show several such press type sprayers, each of which comprises a press button A, a piston rod B, a housing C provided to enclose the opening of a bottle (not shown), a valve D, an internal sleeve E, a cylinder F, a spring G, a nozzle H, and a liquid introducing tube I. In use, the housing C encloses an opening of a bottle (not shown) and the liquid introducing tube I is inserted in the bottle and immersed in the liquid contained in the bottle. When the press button A is pressed down, the piston rod B moves downward along with the valve D within the cylinder F, and when the lower end of the valve D contacts the lower end of the cylinder F, a sealed compression chamber K is formed in the upper portion of the cylinder F, where a small amount of liquid flows in during the movement of the valve D. Further downward movement of the piston rod B reduces the volume of the chamber K and increases the pressure of the liquid in the chamber. When a back pressure in the chamber is larger than the resilient force of the spring G, the valve D is forced to make an instant downward movement such that the liquid in the chamber escapes through a gap formed between the valve D and the piston rod B and is sprayed in an atomized form through the nozzle H located near the press button A.

However, the aforementioned press type sprayers do not provide a satisfactory spraying effect. Whether a spraying effect is satisfactory or not is judged based on two considerations: (1) uniformness of atomization of the sprayed liquid, and (2) instant and sensitive response of spraying (i.e., a short time duration from the actuation of the press button to the actual spraying action from the nozzle). These two factors are determined by the response of the valve D. A slow response of the valve D prolongs the response time from the actuation of the press button to the actual spraying action from the nozzle, and consequently can not provide a sufficient force to spray a necessary amount of liquid in a very short instant. A weak spraying force could lead to ununiformness of atomization and degrade the spraying effect. If the liquid is perfume, a degraded spraying effect would severely deteriorate the quality of the perfume perceived by a consumer even if the perfume itself is of a high quality.

More specifically, the poor spraying effect of the conventional sprayers is resulted from a poor design of the back pressure area of the valve; the movement of the valve D in the chamber K can not result in a smooth upward flow of the liquid contained in the chamber, thereby lowering the sensitivity of the piston rod as well as reducing the amount and atomization effect of the sprayed liquid. As seen from the prior art valve D shown in FIG. 1, the back pressure area D1 thereof is of a step-slant design; hence, liquid pressure can not concentrate on the area, and moreover liquid can not accumulate on the area to provide a sufficient pressure. In the prior art valve D shown in FIG. 2, the back pressure area D2 is designed to be in the form of a reservoir, which may provide a function to accumulate liquid, but it is difficult for liquid to flow smoothly from the lower part of the chamber K upward to the back pressure area D2; consequently, the effect thereof is still poor. In the prior art shown in FIG. 3, the back pressure area D3 is provided with annular teeth, which may provide sufficient areas to receive liquid pressure, but it does still not provide a satisfactory accumulating effect for liquid on the area, and therefore the sprayer can still not provide a perfect spraying effect.

SUMMARY OF THE INVENTION

In view of the foregoing, an object of this invention is to provide an improved valve adapted for a small sprayer, in which a plurality of liquid introduction grooves are provided among thin and fine tubular elements such that liquid may flow effectively and may be sprayed in rapid response to actuation by, e.g., the pressing of a press button.

Another object of this invention is to provide a valve for a sprayer which is provided with teeth-like grooves and an inwardly recessed annular groove so as to accumulate sufficient amount of liquid and to increase the area which receives liquid pressure such that a sensitive valve which brings about instant spraying may be obtained.

The valve according to this invention includes:

a first rod having a smaller diameter, a second rod located below the first rod and having a larger diameter in comparison with that of the first rod, a third rod located below the second rod and having a largest diameter, and a fourth rod located below the third rod and having a reduced diameter in comparison with that of the third rod; wherein a top end of the first rod is formed with a conic shape; an annular shoulder is formed between the first rod and the second rod, on which a plurality of teeth-like grooves are provided; another annular shoulder is formed between the second rod and the third rod, which is inwardly recessed to form an inwardly recessed annular groove; and an outer peripheral surface of the third rod is provided with a plurality of axial liquid introduction grooves.

BRIEF DESCRIPTION OF THE FIGURES

An embodiment of this invention will be described below with reference to the accompanying figures, whereby the objects, features and effects of this invention may be more clearly understood.

DETAILED DESCRIPTION OF THE PREFERRED EMBODIMENTS

Figure 1:
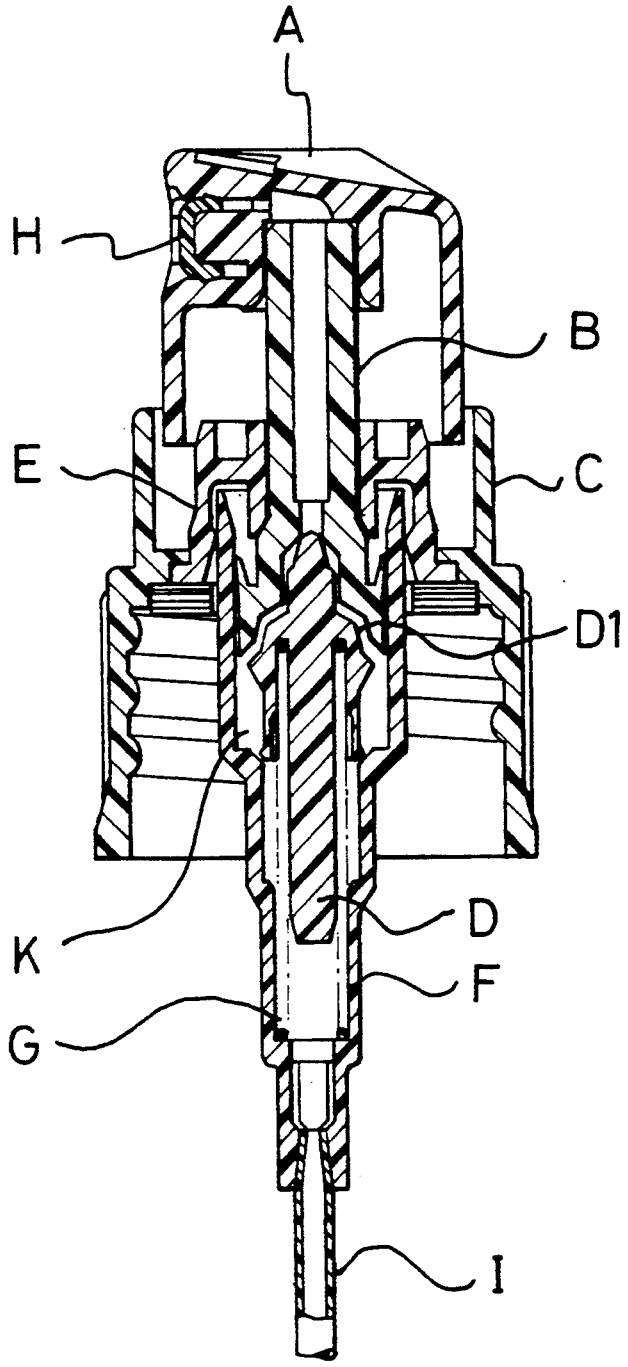
PRIOR ART Fig. 1
FIG. 1 is a cross-sectional view showing the structure of a conventional sprayer.
Figure 2:
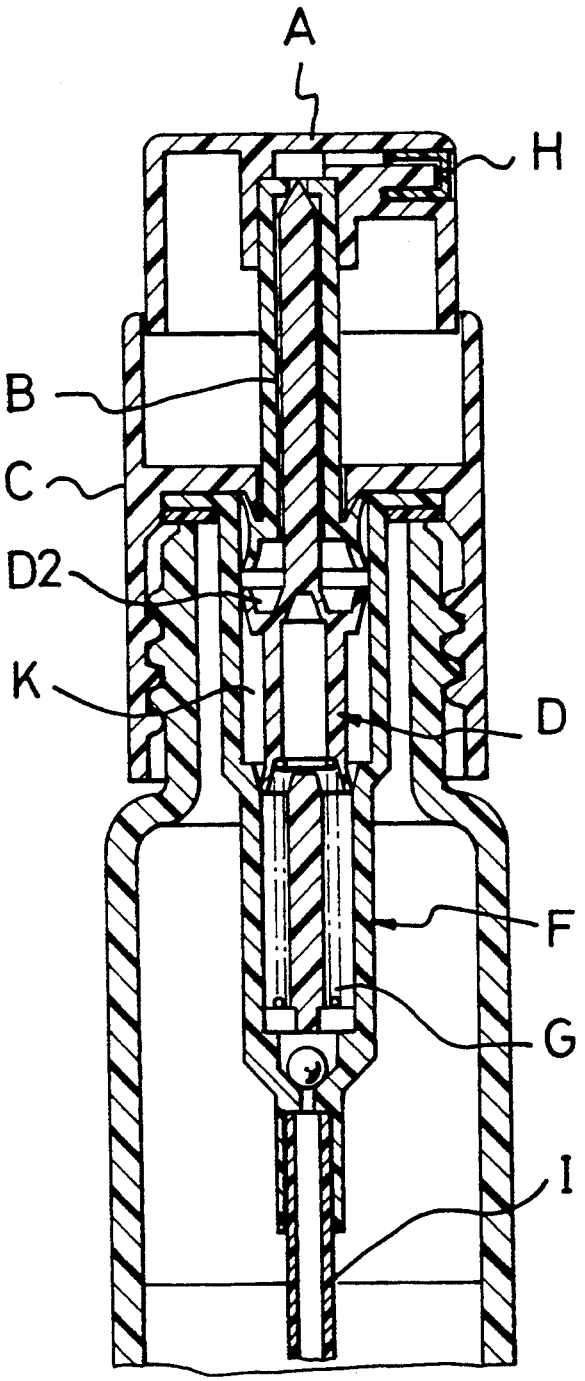
PRIOR ART Fig. 2
FIG. 2 is a cross-sectional view showing the structure of another conventional sprayer.
Figure 3:
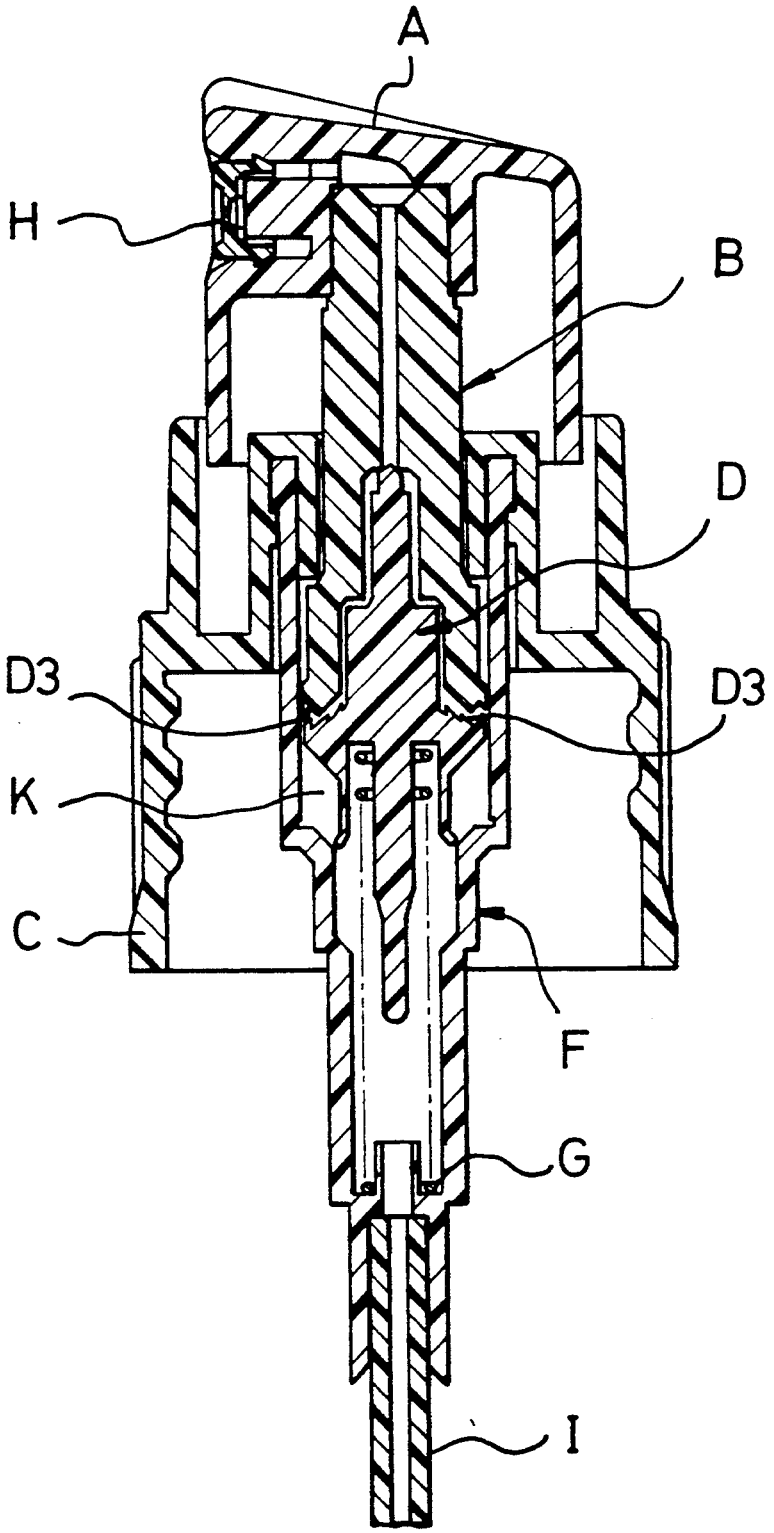
PRIOR ART Fig. 3
FIG. 3 is a cross-sectional view of showing the structure of a still other conventional sprayer.
Figure 4:
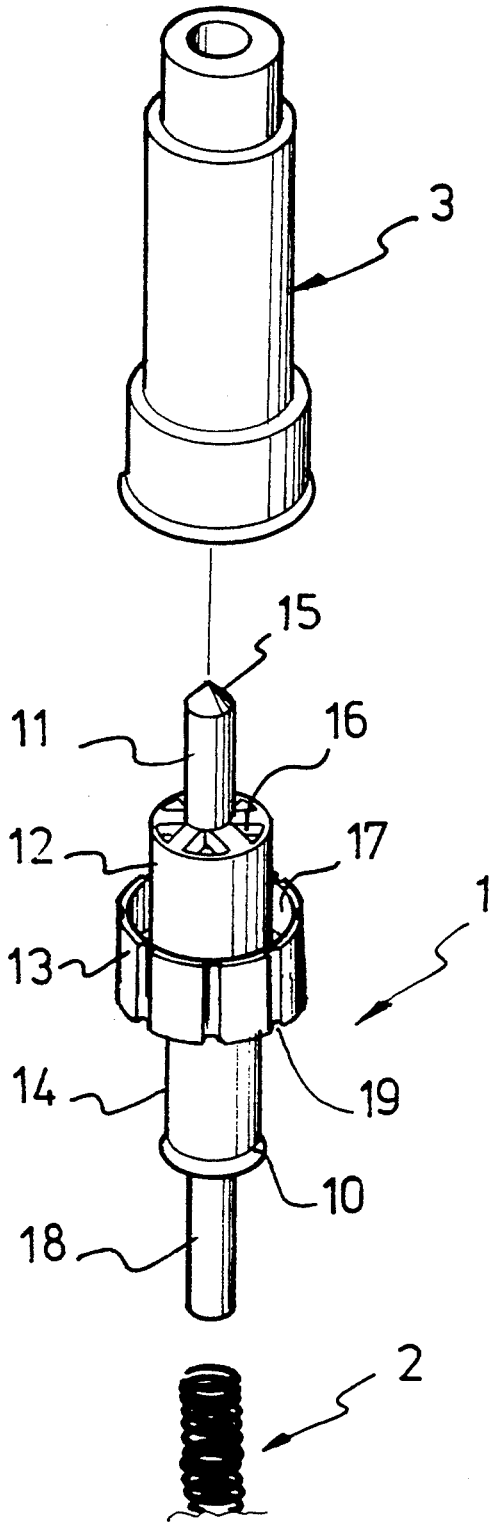
FIG. 4 is a perspective view showing a piston rod for the valve according to this invention.

Referring to FIG. 4, this invention is directed to the improvement of a valve 1 to thereby improved the sensitivity and spraying effect of the sprayer. The valve 1 comprises a first rod 11 having a smaller diameter, a second rod 12 located below the first rod and having a larger diameter, a third rod 13 located below the second rod and having a largest diameter, and a fourth rod 14 located below the third rod and having a reduced diameter in comparison with that of the third rod. The top (uppermost) end of the first rod 11 is formed with a conic shape so as to provide a needle-valve effect. An annular shoulder is formed between the first rod 11 and the second rod 12, on which several teeth-like grooves 16 are provided in a concave-convex teeth-like arrangement, where the outer edges of the concave portions are encompassed by a thin side wall. Another annular shoulder formed between the second rod 12 and the third rod 13 is deeply inwardly recessed to form an inwardly recessed annular groove 17 which is located in a gap formed between a thin peripheral side wall of the third rod 13 and the second rod 12. The outer peripheral surface of the third rod is axially provided with a plurality of thin liquid introduction grooves 19. The bottom (lowermost) end of the fourth rod 14 is provided with a tapered edge 10 and an extending portion 18. The extending portion 18 may be surrounded by a spring 2.

Figure 5:
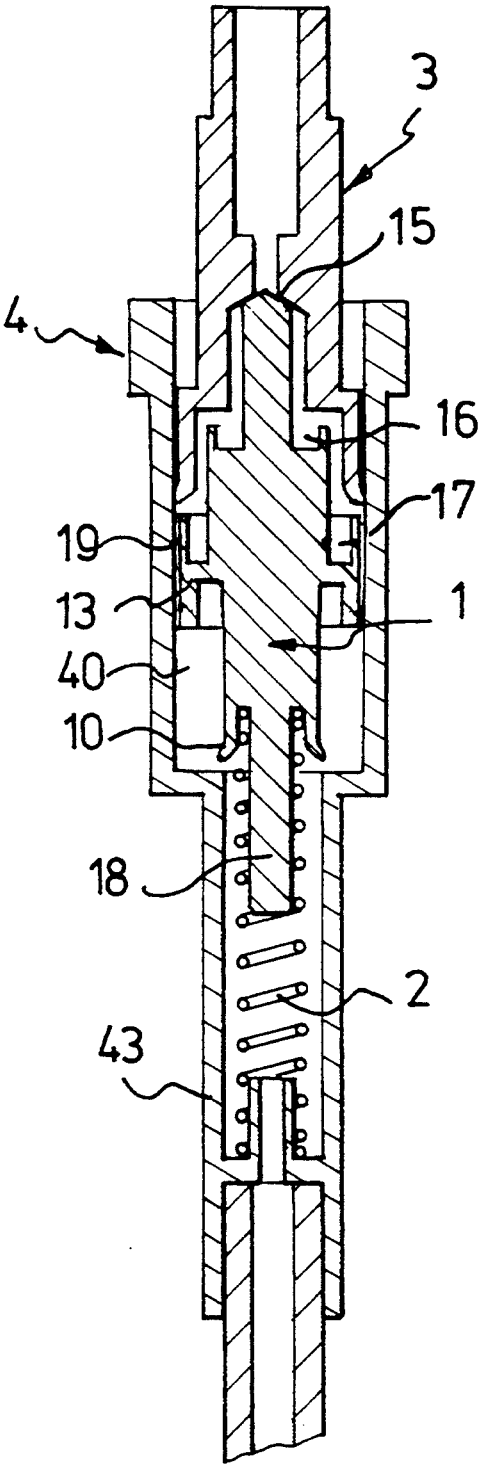
FIG. 5 is a cross-sectional view showing the structure of the valve according to this invention.
Figure 6:
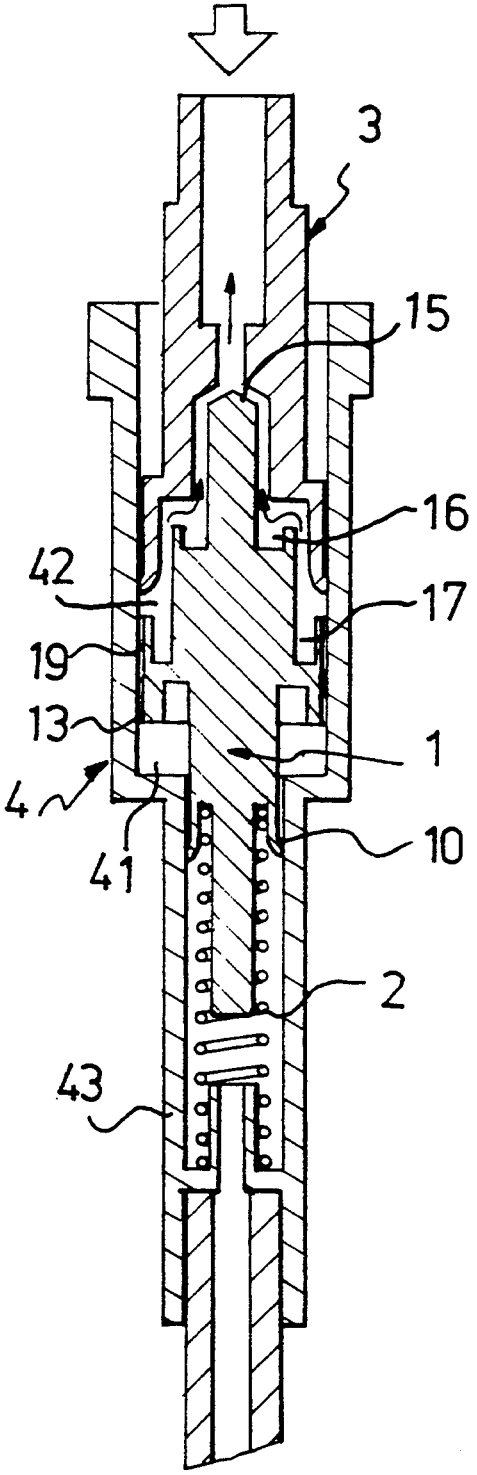
FIG. 6 is a cross-sectional view showing a state where a back pressure is applied.

Referring to FIGS. 5 and 6 where the valve 1 according to this invention is installed in a sprayer, when a piston rod 3 above the valve 1 is pressed to move the valve 1 downward, the tapered edge 10 is inserted into a small cylinder portion 43 below a larger cylinder portion 4 to thereby seal the internal space 40 of the larger cylinder such that the space 40 becomes a compression chamber. The valve 1 continues to move downward in the large cylinder portion 4 and creates downward pressure. At the time the compression chamber 40 is sealed, the third rod 13 abuts against the internal wall of the cylinder portion 4 to divide the compression chamber 40 into a lower compression chamber 41 formed below the third rod 13 and an upper compression chamber 42 formed above the third rod 13. The pressing force transmits downward through the piston rod 3, the valve 1 and the spring 2. The liquid in the compression chamber 40 is compressed and it searches for an outlet where lower pressure exists. The teeth-like grooves 16 and the inwardly recessed annular groove 17 provide sufficient back pressure areas (there are no corresponding areas on the lower surface of the third rod 13 for liquid to exert a corresponding upward force to counteract the back pressure), and therefore the liquid may easily press down the valve 1 by means of the back pressure areas. The downward force is larger than the recovery force of the spring 2 and causes the conic portion 15 to depart from the piston rod 3. Within this instant, the liquid thrusts into the piston rod 3 and sprays out from a nozzle (not shown).

A sufficient amount of liquid is required to press the valve 1 downward in the compression chamber 40 of the cylinder portion 4. Accordingly, the liquid in the lower compression chamber 41 has to effectively flow upward when the valve 1 is pressed downward, such that a smooth mutual movement between the liquid and the valve 1 may be achieved and the liquid may effectively spray through the piston rod 3 within the instant when the valve 1 moves downward due to the back pressure. Generally in a small sprayer, the cylinder portion 4 thereof has a small bore, and therefore there is not much clearance left between the periphery of the valve 1 and the internal wall surface of the cylinder when the valve 1 is installed. According to this invention, the outer wall surface of the third rod 13 is provided with a plurality of axial liquid introduction grooves 19, which may effectively introduce liquid from the lower compression chamber 41 to the upper compression chamber 42. The teeth-like grooves 16 and the inwardly recessed annular groove 17 not only accumulate sufficient amount of liquid but also provide sufficient back pressure areas, whereby an excellent spraying effect is obtained.

It should be noted that the above description is for illustration rather than limitation, and any modification which can be readily made by one skilled in this art should be interpreted to fall within the scope of the following claim.

I claim:

1. A sprayer comprising a press button, a piston rod, a nozzle, a spring, a cylinder and a liquid introduction tube, characterized by an improved valve including:

a first rod, a second rod located below said first rod and having a larger diameter in comparison with that of said first rod, a third rod located below said second rod and having a largest diameter, and a fourth rod located below said third rod and having a reduced diameter in comparison with that of said third rod; wherein a top end of said first rod is formed with a conic shape; an annular shoulder is formed between said first rod and said second rod, on which a plurality of teeth-like grooves are provided; another annular shoulder is formed between said second rod and said third rod, which is inwardly recessed to form an inwardly recessed annular groove; and an outer peripheral surface of said third rod is provided with a plurality of axial liquid introduction grooves.

* * * * *